United States Patent [19]

Ohyabu et al.

[11] Patent Number: 4,896,191

[45] Date of Patent: Jan. 23, 1990

[54] SHEET TRANSFERRING MECHANISM IN AN ELECTROPHOTOGRAPHIC RECORDING APPARATUS

[75] Inventors: Keiji Ohyabu; Youji Houki, both of Tokyo; Shinichi Watarai, Yokohama; Tomohiro Nonomura, Takasago, all of Japan

[73] Assignee: Fujitsu Limited, Kawasaki, Japan

[21] Appl. No.: 241,245

[22] Filed: Sep. 7, 1988

[30] Foreign Application Priority Data

Sep. 10, 1987 [JP] Japan ..... 62-233728
Mar. 19, 1988 [JP] Japan ..... 63-57003

[51] Int. Cl.[4] ..... G03G 15/14; G03G 21/00
[52] U.S. Cl. ..... 355/309; 355/271
[58] Field of Search ..... 355/309, 316, 317, 321, 355/271, 274; 271/226, 227, 275, 160

[56] References Cited

U.S. PATENT DOCUMENTS 3,905,697 9/1975 Komori et al. ..... 271/160 X
4,803,510 2/1989 Maeda ..... 355/271 X

*Primary Examiner*—A. T. Grimley
*Assistant Examiner*—S. L. Hoffman
*Attorney, Agent, or Firm*—Staas & Halsey

[57] ABSTRACT

A gap produced between a sheet intruding guide and a surface of a drum is kept to a predetermined value with an allowable tolerance by positioning the sheet intruding guide together with an image transcription unit placed under the drum and constantly pushed toward the drum surface so that a space between the drum surface and the image transcription unit is kept constant. The sheet intruding guide can be lifted up and held away from the image transcription unit when the drum is removed upward, and released from the holding and set back to its regular position mechanically when the drum is lowered back to its regular position.

6 Claims, 8 Drawing Sheets

SHEET TRANSFERRING MECHANISM IN AN ELECTROPHOTOGRAPHIC RECORDING APPARATUS

BACKGROUND OF THE INVENTION

1. Field of the Invention

The present invention relates to an electrophotographic recording apparatus and particularly to a sheet transferring mechanism of an image transcription unit provided in the electrophotographic recording apparatus.

Recently, an electrophotographic recording apparatus such as an electrically printer or duplicator is widely used for electrically recording letters and/or images onto recording sheets. The electrophotographic recording apparatus, which will be simply called as the "recording apparatus" hereinafter, comprises: a photoconductive drum; a charger for electro-statically charging a surface of the photoconductive drum; a light irradiating unit for irradiating an optical image onto the surface of the photoconductive drum so that a latent image is formed on the surface of the charged photoconductive drum; a developing unit for developing the latent image by using toner so that a toner image appears on the surface of the photoconductive drum; an image transcription unit for transcribing the toner image onto a recording sheet; a sheet transferring mechanism for transferring the recording sheets into and out of the image transcription unit one by one, synchronizing with the rotation of the photoconductive drum; an image fixing unit for fixing a toner image transcribed on each recording sheet; and a cleaner for cleaning the toner left on the surface of the photoconductive drum after the transcription of the toner image on the recording sheet is over. Furthermore, the sheet transferring mechanism provided around the image transcription unit includes a sheet intruding guide and a sheet extruding guide. The sheet intruding guide is located at a sheet entrance of the image transcription unit for intruding the recording sheet into the image transcription unit and a sheet extruding guide is located at a sheet exit of the image transcription unit for extruding the recording sheet after the toner image is transcribed on the recording sheet.

In the recording apparatus, a gap provided between the sheet intruding guide and the photoconductive drum and a gap provided between the sheet extruding guide and the photoconductive drum are very significant. The values of these gaps are determined in consideration of various conditions such as the rotating speed of the photoconductive drum, the size and the physical property of the recording sheet, an intruding point of the recording sheet to the rotating surface of the photoconductive drum, and an intruding angle of the recording sheet to the surface of the rotating photoconductive drum at the intruding point. If the gaps vary with the rotation of the photoconductive drum as much as to exceed allowable values, the tip and/or the end of the intruded recording sheet is fluttered in the image transcription unit, causing the toner image transcribed on the recording sheet to lack in uniformity, which results in exerting a harmful influence on the quality of the recorded image on the recording sheet.

Furthermore, in the recording apparatus, the units such as the photoconductive drum and the cleaner are unified into one unit called a "drum unit". This is for allowing the users of the recording apparatus to easily exchange these units when some of the units are worn.

Actually, the drum unit is exchanged periodically particularly in consideration of the life of the photoconductive drum. However, the image transcription unit is hard to be unified into the drum unit because dust such as the toner powder worn off from the surface of the photoconductive drum and the sheet trash from the recording sheet are left in the image transcription unit before the life of the image transcription unit is over. Therefore, the image transcription unit must be periodically cleaned up for maintaining its correct operation. Accordingly, whenever the process unit is exchanged or the image transcription unit is cleaned, the great attention must be payed for keeping the gaps in the designated value, which is not always easy to be done. Therefore, it can be said that if the gaps can be always kept constant easily even though the exchange or the cleaning is carried out by the users, the recording apparatus comes to be used more widely.

2. Description of the Prior Art

A side view of an image transcription unit and the prior art sheet transferring mechanism around the image transcription unit are illustrated in FIG. 1. In FIG. 1, a photoconductive drum 1, which will be simply called a "drum 1" hereinafter, is rotated counterclockwise around an axis 1' as shown in a rotational direction $D_1$. An image transcription unit 3 is placed just under the drum 1, having a space 4, and the toner image on the drum 1 is transcribed onto the recording sheet when the recording sheet passes through the space 4. The recording sheet is sent to the space 4 through a sheet intruding guide 2 composed of a guide frame 5 and a plastic film 6 fixed on the guide frame 5. The upper surface of the plastic film 6 is parallel to the axis 1' and the tip edge, toward the surface of the drum 1, of the plastic film 6 is also parallel with the axis 1' and provides a gap A to the surface of the drum 1. The recording sheet sent to the upper surface of the plastic film 6 is guided to the rotating surface of the drum 1 through the gap A and rolled into the space 4 in a state that the recording sheet sticks fast to the rotating surface of the drum 1. Therefore, when the recording sheet is arrived to the space 4, the toner image on the surface of the rotating drum 1 is transcribed to the surface of the recording sheet by the electrostatic force provided from the image transcription unit 3.

The image transcription unit 3 is composed of: a corona charger 8 which produces an electrostatic force by which the toner image on the surface of the rotating drum 1 is transcribed to the surface of the recording sheet; and a corona discharger 9 for discharging the charge on the recording sheet so that the recording sheet having been stuck onto the surface of the drum 1 can be easily peeled off from the surface of the drum 1 after the transcription is over. The corona charger 8 and the corona discharger 9 have wires 7 and 7' respectively for making them operate properly, and they are separated by a separating wall 77. On the upper edge of the separating wall 77, a sheet extruding guide 10 consisting of a plurality of guide pieces is fixed, which is illustrated by a partial plan view of the image transcription unit 3 in FIG. 2. The guide pieces are arranged in a plane parallel to the axis 1' aslant to the sheet transferring direction D so that halves of them are arranged in different direction having the same angle from the direction $D_2$ as shown in FIG. 2. This is for extruding the recording sheet from the sheet extruding guide 10 straight along the direction $D_2$.

In FIG. 1, the axis 1', the sheet intruding guide 2, the image transcription unit 3 and the sheet extruding guide 10 are all fixed to a base frame, which is not depicted in FIG. 1, of the recording apparatus. Therefore, it is very hard to maintain the values of the gaps A and B in high accuracy under a condition that the drum 1 must be periodically removed for exchanging or for cleaning the inside of the image transcription unit 3. For example, even though the gaps A and B are determined so as to be 0.5 mm±0.2 mm and 1.5 mm±0.3 mm respectively for obtaining the high quality of the transcribed image on the recording sheet, it will be very hard to set the gaps A and B with the above tolerance. Because, usually the eccentricity of the drum 1 is 0.15 mm, the positioning accuracy of the wire 7 or 7' is 0.1 mm, the positioning accuracy of the sheet intruding guide 2 is 0.1 mm, and furthermore there is a little variation of the radius of the drum 1. It cannot be said impossible to manufacture the recording apparatus with high accuracy; however, the manufacturing cost becomes extremely high, and this high cost cannot be allowed in the commercial price of the recording apparatus.

SUMMARY OF THE INVENTION

Therefore, in the recording apparatus, an object of the present invention is to increase the quality of the transcribed image on the recording sheet, avoiding the occurrence of faulty image transcription such as shear, luck or light-and-shade of the transcribed image even though the removement of the units such as the drum unit or the cleaning of the image transcription unit is carried out periodically.

Another object of the present invention is to make the exchange of the units such as the drum unit and the cleaning of the units such as the image transcription unit easy, without paying particular attention to the quality of the transcribed image on the recorder sheet.

Still another object of the present invention is to improve the work of exchanging the units such as the drum unit or of cleaning the units such as the image transcription unit, so as to be capable of performing more easily than usual.

The above objects can be achieved by maintaining the gaps produced between the sheet intruding guide and the drum and between the sheet extruding guide and the drum in high accuracy. To ensure the high accuracy to these gaps, the following improvement is applied to a mechanism related to the sheet intruding guide, the image transcription unit and the sheet extruding guide:

(1) The image transcription unit having been fixed to the base frame of the recording apparatus is made free from the base frame and always pushed to the surface of the drum through rollers so that a space between the surface of the drum and the image transcription unit is always kept constant during the rotation of the drum even though the axis of the drum is eccentrically fixed to the base frame and/or the radius of the drum varies; wherein, the pushing force is provided by pushing means such as springs. A horizontal pedestal generally called a canopy top is provided to a unit case of the image transcription unit. The sheet intruding guide is provided at an end part of a long arm sustained by an axis set to the base frame, so that the sheet intruding guide is moved downward. A sliding face directed downward is provided at an edge portion at the end of the long arm so that the sliding face is always touched to the horizontally flat surface of the canopy top by the weight of the long arm itself sustained by the axis. Doing so, the sheet intruding guide is always positioned, keeping the gap between the surfaces of the sheet intruding guide and the drum in high accuracy within an allowable tolerance.

(2) The sheet excluding guide is fixed to the image transcription unit, so that the gap between the surfaces of the drum and the sheet extruding guide can be kept constant.

(3) When the drum or the drum unit including the drum is removed for cleaning the inside of the image transcription unit, the cleaning work has been disturbed by the sheet intruding guide. Therefore, an arm holder, by which the arm attached to the sheet intruding guide is held, is provided to the base frame for keeping the sheet intruding guide from the image transcription unit. When the drum or the drum unit including the drum is reinstalled to the regular position, the arm is released from the holder so that the sheet intruding guide is set to the regular position mechanically with the reinstalling of the drum or the drum unit.

Introducing the above improvements (1) and (2) to the sheet transferring mechanism accompanied with the mounting mechanism of the image transcription unit, the gap between the surfaces of the drum and the sheet intruding guide and the gap between the surfaces of the drum and the sheet extruding guide can be kept the designated value with the allowed tolerance.

Introducing the above improvement (3) to the recording apparatus, the removement of the drum and the cleaning of the image transcription unit can be carried out easily without paying particular attention to the accuracy of the gaps.

BRIEF DESCRIPTION OF THE DRAWINGS

FIG. 7(*b*) is a cross-sectional side view of the electrophotographic recording apparatus having a sheet transferring mechanism according to a second embodiment of the present invention, in the case that the upper frame is closed;

FIG. 8(*b*) is a cross-sectional view of the arm attached to the sheet intruding guide when the arm is released from the holder;

FIG. 8(*c*) is a cross-sectional view of the arm attached to the sheet intruding guide when the arm is held by the holder.

DETAILED DESCRIPTION OF THE PREFERRED EMBODIMENT

An electrophotographic recording apparatus, which will be simply called as a "recording apparatus" as stated before hereinafter, embodying the present invention will be described in reference to FIGS. 3 to 8.

As a sheet transferring mechanism in the recording apparatus is a point of the present invention, the recording apparatus including the sheet transferring mechanism will be described as a first embodiment of the present invention in reference to FIGS. 3 to 6.

As a second embodiment of the present invention, a mechanism to hold up the sheet intruding guide for making the cleaning or exchanging of the image transcription unit easy will be described in reference to FIGS. 7 and 8.

Figure 1:
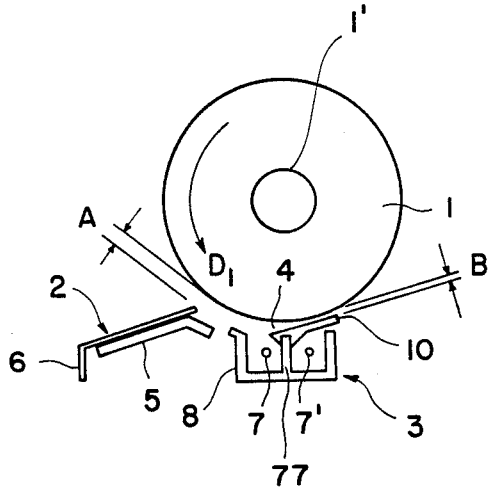
FIG. 1 is a schematic cross-sectional view of a conventional sheet transferring mechanism near to an image transcription unit of an electro-photographic recording apparatus.
Figure 2:
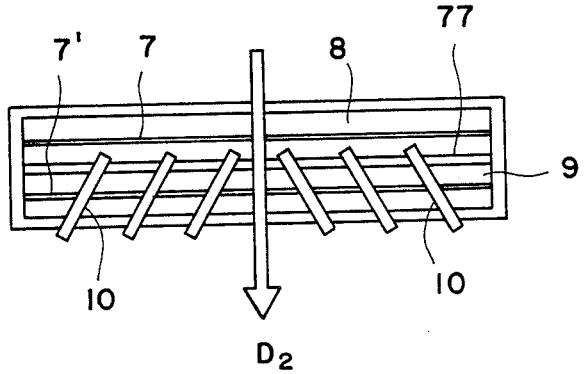
FIG. 2 is a schematic plan view of the conventional image transcription unit.
Figure 3:
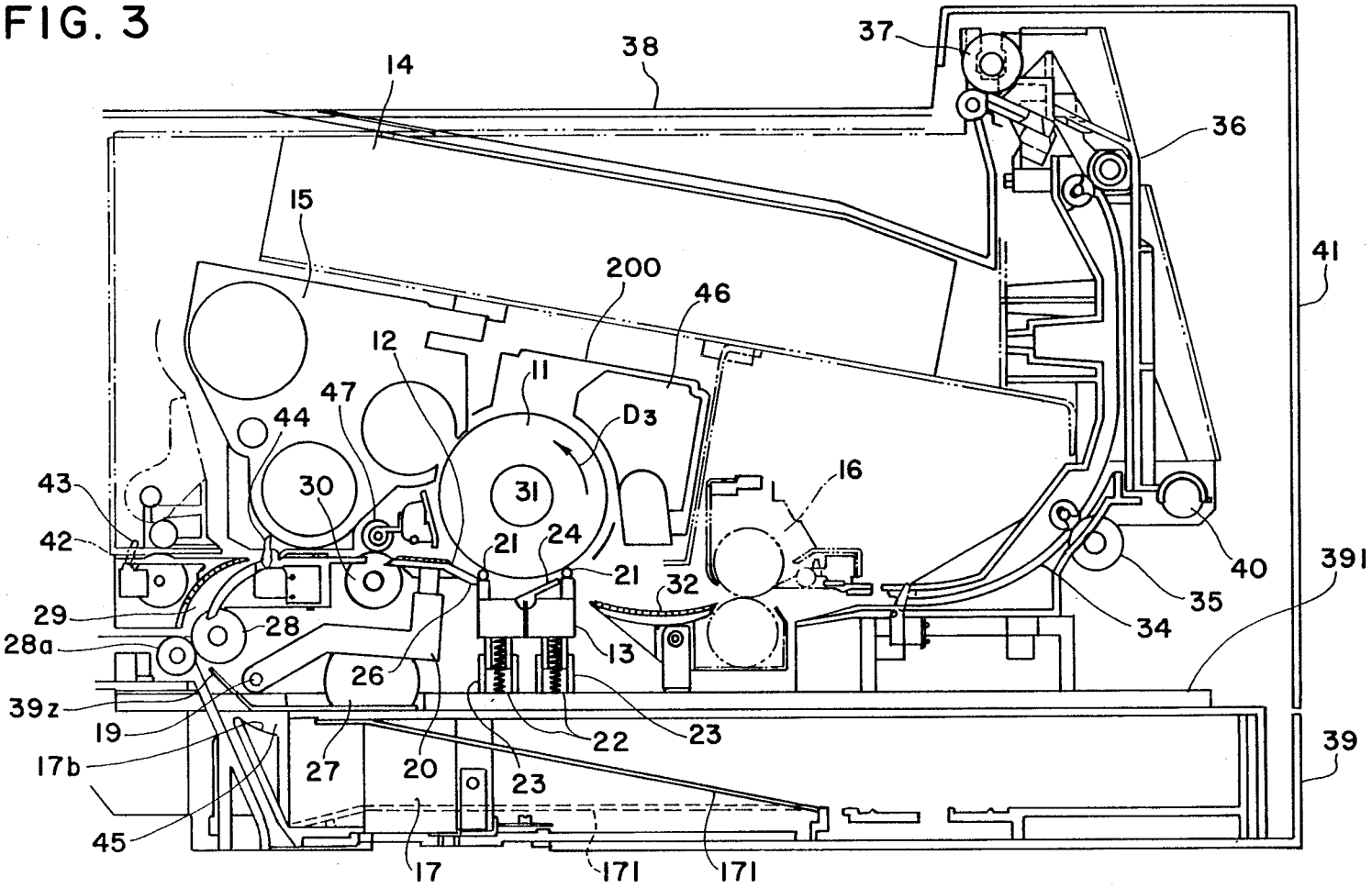
FIG. 3 is a side view schematically showing internal structure of an electrophotographic recording apparatus having a sheet transferring mechanism according to a first embodiment of the present invention.
Figure 4:
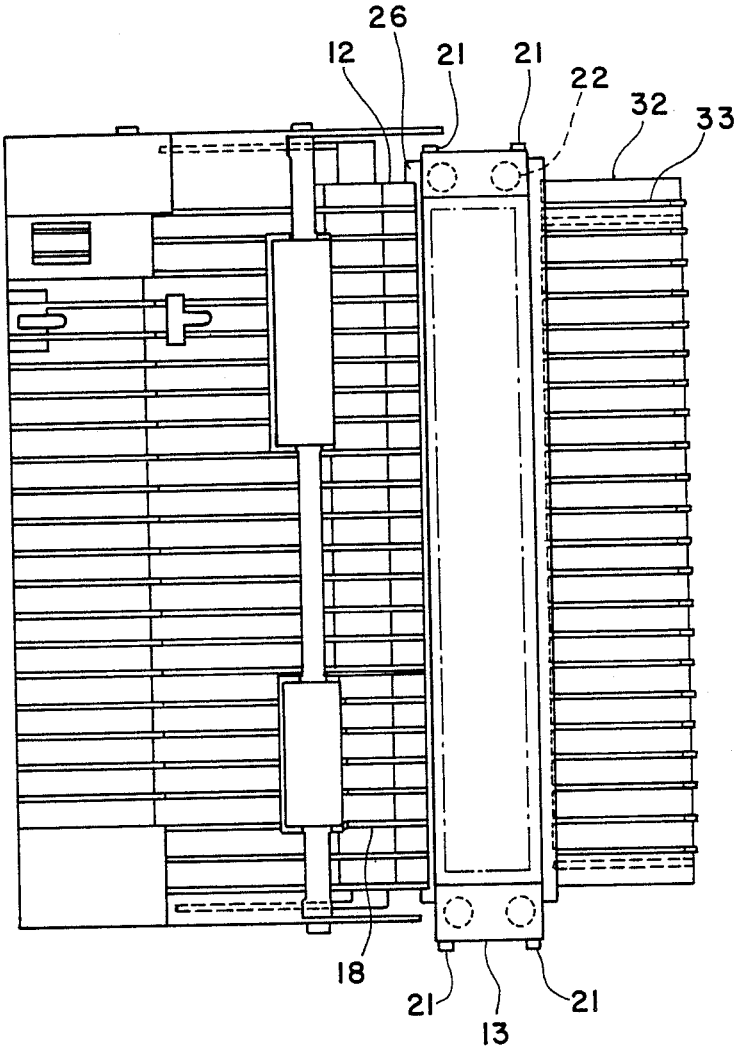
FIG. 4 is a schematic plan view of the sheet transferring mechanism, near to the sheet transcription unit, according to a first embodiment of the present invention.
Figure 5:
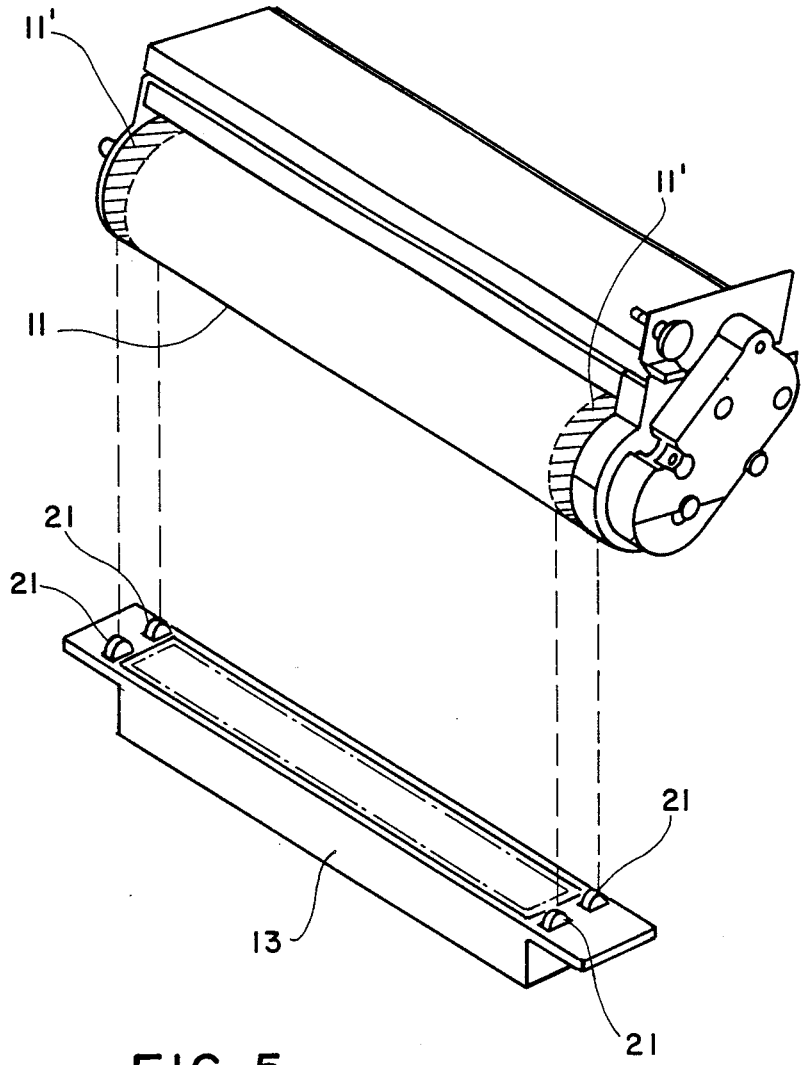
FIG. 5 is a perspective view schematically illustrating the photoconductive drum and the image transcription unit pushed to the cylindrical surface of the photoconductive drum through the rollers.

In FIGS. 3, 4 and 5, the same reference numeral designates the same unit or part.

FIG. 3 illustrates a side view of the internal structure of the recording apparatus by mainly showing the sheet transferring mechanism. In FIG. 3, a sheet intruding guide 12 provided at an entrance of an image transcription unit 13 is attached to an end of a long arm 20 so as to be rotated around an axis 19 provided to another end of the arm 20. The sheet intruding guide 12 has a plurality of guide pieces 18 on its surface for guiding the recording sheet to a photoconductive drum 11 which will be simply called a "drum 11" as stated before hereinafter. The guide pieces 18 lie in a transferring direction of the recording sheet as shown in FIG. 4.

The image transcription unit 13 is provided so as to be moved up and down along a vertical radial direction of the drum 11 and has two pairs of rollers 21 contact to the side regions 11' of a cylindrical surface of the drum 11 as shown in FIG. 5; wherein, there is no latent image on the side regions 11' because a photoconductive film is not formed thereon. FIG. 5 shows a perspective view of the drum 11 and the image transcription unit 13 pushed to the cylindrical surface of the drum 11 through the rollers 21. (In FIG. 5, the image transcription unit 13 is illustrated by only showing its unit case. The structure in the unit case is omitted to show, as depicted by a square of one dot chained line, for the sake of simplicity. The same omission is also done in FIG. 4. And, in FIG. 5, the pinch rollers 47 are also omitted to show.) Accordingly, the image transcription unit 13 is always positioned so that the space between the surfaces of the drum 11 and of the image transcription unit 13 is kept constant to a designated value. This is for obtaining the high quality of the transcribed image on the recording sheet.

Figure 6:
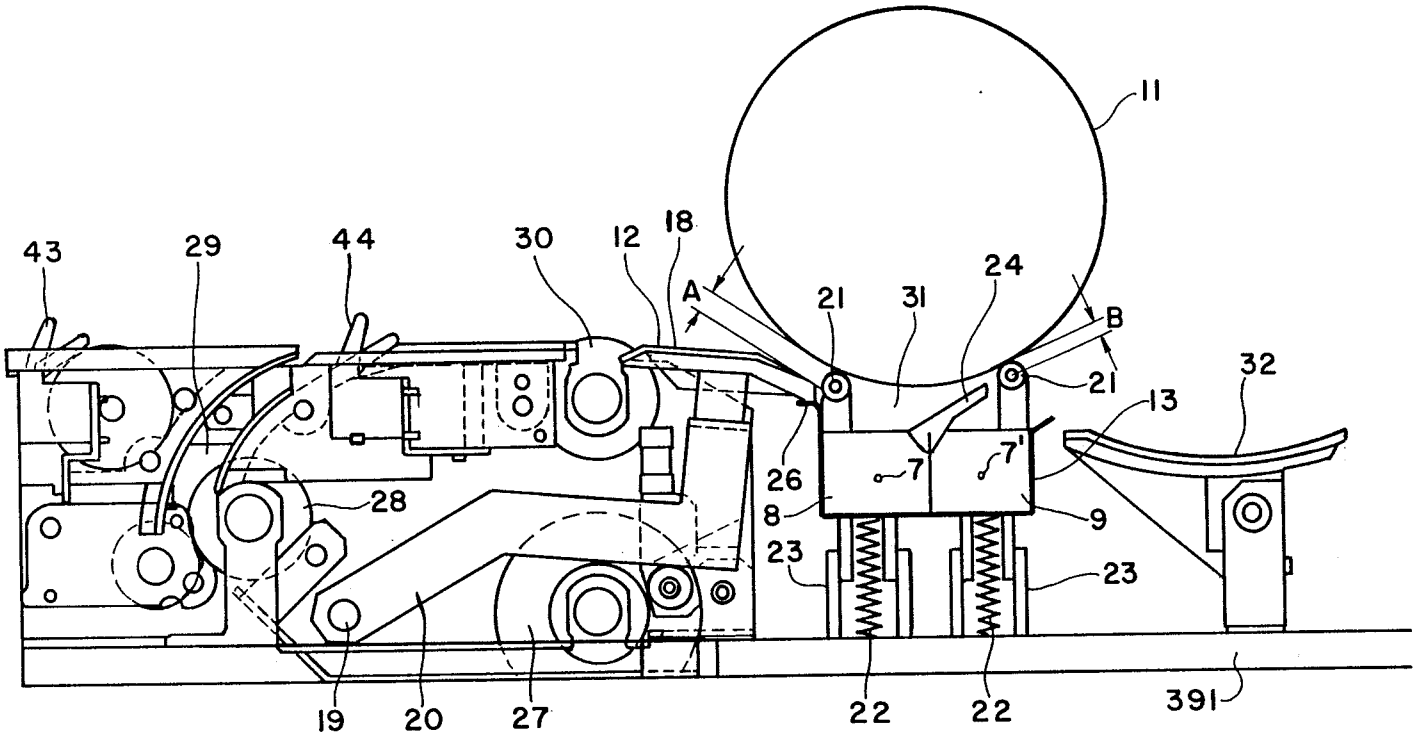
FIG. 6 is a cross-sectional side view schematically showing an enlarged portion of the sheet transferring mechanism according to a first embodiment of the present invention.

In FIG. 6, a cross-sectional side view of the sheet transferring mechanism is partially illustrated. As shown in FIG. 6, the image transcription unit 13 is pushed up to the drum 11 from a base frame 391 of the recording apparatus through springs 22, and the image transcription unit 13 is moved up and down along the guide cylinders 23 in which the springs 22 are installed. As long as the rollers 21 contact to the cylindrical surface of the drum 11, a sheet extruding guide 24 attached to the image transcription unit 13 is positioned so that a gap B between the surfaces of the sheet extruding guide 24 and of the surface of the drum 11 is kept constant. The rollers 21 always contact to the surface of the drum 11 because the pushing force of the springs 22 is strong and the rotational speed of the drum 11 is slow enough to keep the contact sufficiently. In the image transcription unit 13, the position of the wire 7 in the corona charger 8 against the surface of the drum 11 is important to produce high quality of the transcribed image on the recording sheet. The above positioning structure of the image transcription unit 13 is very effective to maintain the correct position of the wire 7 to the surface of the drum 11.

The end of the sheet intruding guide 12 is supported by a canopy top 26 attached to a unit case of the image transcription unit 13 and slides on the surface of the canopy top 26 in accordance with the motion of the image transcription unit 13. The rotational speed of the drum 11 is so low that the end of the sheet intruding guide 12 does not leave from the canopy top 26. Therefore, as long as the image transcription unit 13 is positioned properly in accordance with the above positioning structure, the gap A between the surface of the sheet intruding guide 12 and the surface of the drum 11 can be set to an approximately constant value. In other words, the gaps A and B can be set simultaneously to a proper value within an allowable tolerance respectively.

Consequently, in the recording apparatus firstly embodying the present invention, the image is recorded on the recording sheet in the following procedure in reference to FIG. 3:

(1) The drum 11 is rotated counter-clockwise as shown by a rotational arrow mark $D_3$ and the surface of the drum 11 is charged by a charger which is not shown in FIG. 3. The latent image corresponding to an image to be recorded is formed on the surface of the drum 11 by a latent image forming unit 14 and the latent image is developed to a toner image by a developing unit 15.

(2) On the other hand, the recording sheets are stocked in a sheet cassette unit 17 located under the base frame 391 as shown in FIG. 3. The sheet cassette unit 17 has the structure so as to be drawn out from the recording apparatus in a left direction on the paper of FIG. 3. The recording sheets are not depicted in FIG. 3, however actually they are set in the sheet cassette unit 17, pushing a receiving plate 171 downward as shown by that drawn by a dotted line; wherein the receiving plate 171 is made of spring material so that the recording sheets set in the sheet cassette unit 171 are always pushed upward. The recording sheet is picked up one by one by a pick up roller 27, so that the recording sheet jumps over a sheet stopper pieces 17 and sent to a first sending roller 28 through a slit 45 and guide walls 17*b* and 39*z*. The recording sheet arrived at the first sending roller 28 is drived with the pinch roller 28*a* so as to be sent to a second sending roller 30 through a slit 29 and a sensor 44. The recording sheet arrived at the second sending roller 30 is drived with the pinch roller 47 so as to be sent to the image transcription region 31 through the sheet intruding guide 12 and the gap A. The sensor 44 is to sense the recording sheet passing therethrough for controlling the driving timing for the pick up roller 27, the first sending roller 28 and the second sending roller 30. The control is performed in synchronization with the rotation of the drum 11 for correctly transcribing the toner image onto the recording sheet. Then, the toner image is transcribed to the recording sheet at the image transcription unit 13. After the image transcription is over, the recording sheet is transferred to a sheet guide 32 through the gap B and sent to a fixing unit 16 where the toner image is fixed on the recording sheet. On the surface of the sheet guide 32, a plurality of protrusions are provided as shown in FIG. 4. The protrusions are for sending the recording sheet straight to the fixing unit 16.

In the above steps (1) and (2), since the gaps A and B are kept constant with an allowable tolerance respectively, the toner image can be transcribed to the recording sheet without any fluttering at the front and rear ends of the recording sheet even though the drum 11 rotates eccentrically and/or the surface of the drum 11 is not formed in a complete circle.

(3) After the toner image on the recording sheet is fixed at the fixing unit 16, the recording sheet is transferred by push rollers 35, 36 and 37 through a sheet guide 34 and ejected and laid on a sheet tray 38 in a face down state.

(4) The cylindrical surface of the drum 11 is cleaned by a cleaner 46 after the image transcription is over.

In the recording apparatus firstly embodying the present invention, the base frame of the recording apparatus is separated to two frames, an upper frame and a lower frame. In FIG. 3, reference numerals 41 and 39 indicate the upper frame and the lower frame respectively. Furthermore, in this embodiment, the drum 11, the cleaner 46, the charger which is not depicted in FIG. 3 and the pinch roller 47 facing to the second sending roller 30 are unified to a drum unit 200, and the drum unit 200 is installed in the upper frame 41. This situation can be seen clearly in FIG. 7(*a*) which is for a second embodiment however the situation of these units in the recording apparatus is the same as that in FIG. 3.

The recording sheet can be fed manually through an entrance 42. In this case, the recording sheet is transferred directly to the second sending roller 30 as shown in FIG. 3 and transferred to the image transcription unit 13 through the same route as described above. The sheet transferring is controlled by a monitoring system using sensors 43 and 44 which detect the sheet passing through the respective sheet path.

Figure 7:
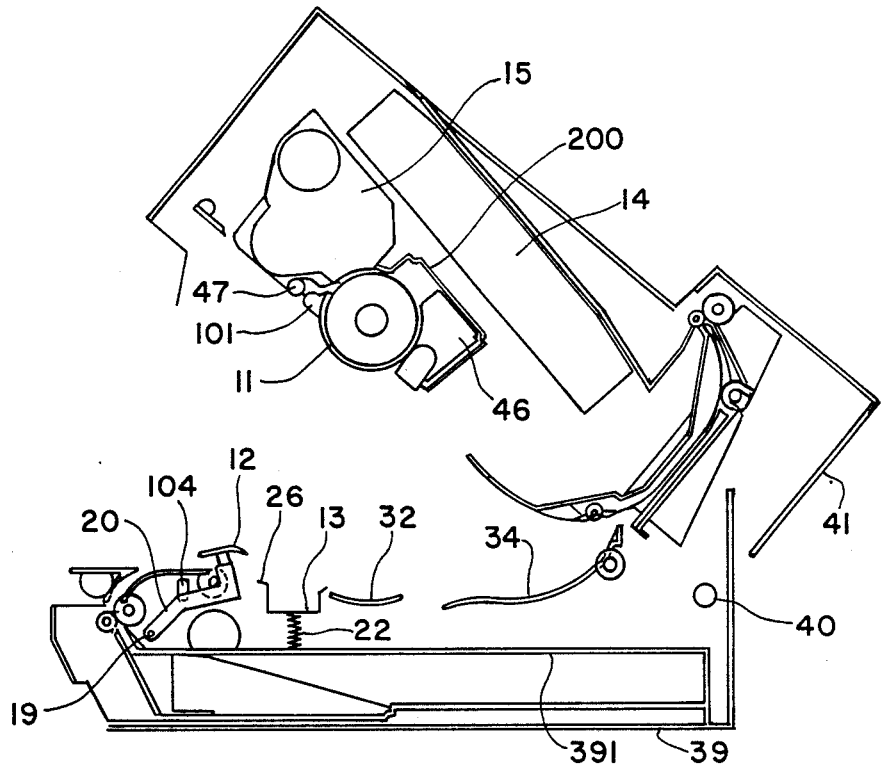
FIG. 7(*a*) is a cross-sectional side view of the electrophotographic recording apparatus having a sheet transferring mechanism according to a second embodiment of the present invention, in the case that an upper frame of the electrophotographic recording apparatus is opened.
Figure 7:
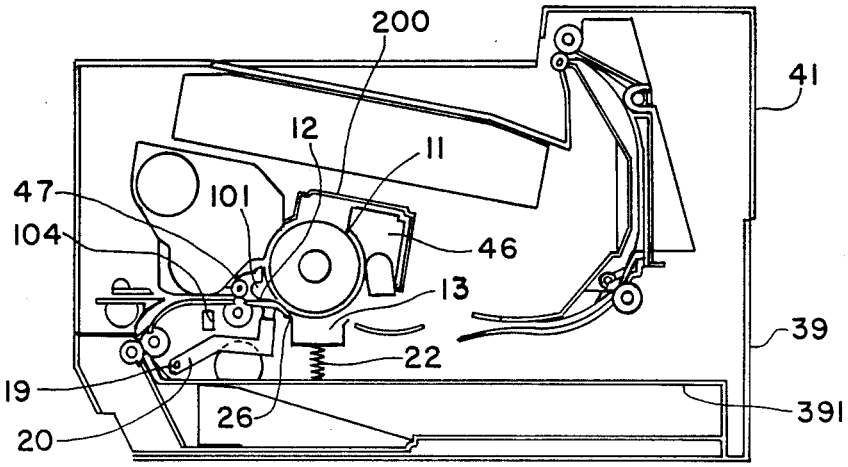

The drum unit 200 can be exchanged by firstly lifting up the upper frame 41 as shown in FIG. 7(*a*) and secondly drawing the drum unit 200 out from the upper frame 41 in a direction perpendicular to the paper of FIG. 7(*a*). By doing so, the drum unit 200 can be exchanged without touching any place around the gaps A and B, which results in keeping the gaps A and B constant in high accuracy.

In this embodiment, the gap A is set to 0.5 mm±0.2 mm and the gap B is set to 1.5 mm±0.3 mm. These values are determined experimentally under 70 mm/s of a transfer speed of the recording sheet, which corresponds to 23 RPM of a rotational speed of the drum 11. In this case, the distance between the surface of the drum 11 and the wire 7 of the corona discharger 8 is set to 8.5 mm±0.1 mm.

According to the first embodiment, the exchange of the drum unit 200 and the cleaning of the image transcription unit 13 become easy to be carried out for the users so that the users can do them without asking the help of a maintenance professional.

Meanwhile, a second embodiment of the present invention is to give more handiness for exchanging the drum unit 200 and cleaning the image transcription unit 13 to the users.

When the image transcription unit 13 is required to be cleaned, the upper frame 41 is opened as stated before, so that the inside of the image transcription unit 13 can be easily looked. However, the sheet intruding guide 12 is set on the canopy top 26, so that the action of cleaning is disturbed by the sheet intruding guide. Therefore, the sheet intruding guide 12 must be removed by lifting up the arm 20 manually and held by hand during the cleaning of the inside of the image transcription unit 13. The second embodiment is for improving this problem.

In the second embodiment, a holder 104 is added to a wall standing at the base frame 391 as shown in FIGS. 7(*a*) and 7(*b*); the wall is omitted to be depicted in FIGS. 7(*a*) and 7(*b*). In FIGS. 7(*a*) and 7(*b*), a cross-sectional side view of the recording apparatus including the holder 104 according to the second embodiment is illustrated.

In FIG. 7(*a*), the upper frame 41 is opened and the image transcription unit 13 is in the highest position because it pushed up by the spring 22, and the sheet intruding guide 12 is manually removed from the canopy top 26 and held by making the arm 20 hold to the holder 104.

Figure 9:
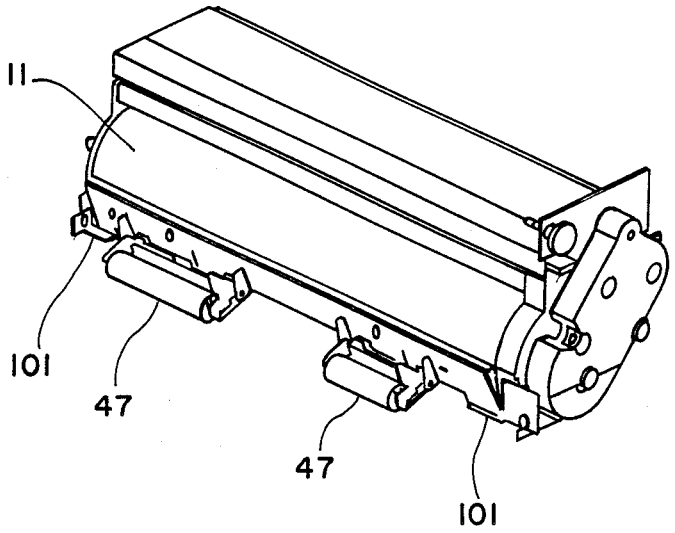
FIG. 9 is a perspective view for illustrating the pushing member provided to the unit case of the drum unit.

In FIG. 7(*b*), the upper frame 41 is closed. During the upper frame 41 is closed, the sheet intruding guide 12 is pushed down by a pushing member 101 provided to the upper frame 41 so that the arm 20 is released from the holder 104. The pushing member 101 is attached to the drum unit 200 as shown in FIG. 9. The pushing member 101 is provided to the drum unit 11 by processing a board attached to a unit case of the drum unit, 11 for mounting the pinch rollers 47. Two member pieces of the pushing member 101 are provided at the both sides of the board as shown in FIG. 9. When the upper frame 41 is closed completely, the sheet intruding guide 12 is placed back to the canopy top 26, and at the same time, the image transcription unit 13 is pushed down to the regular position by the descending drum 11.

Figure 8:
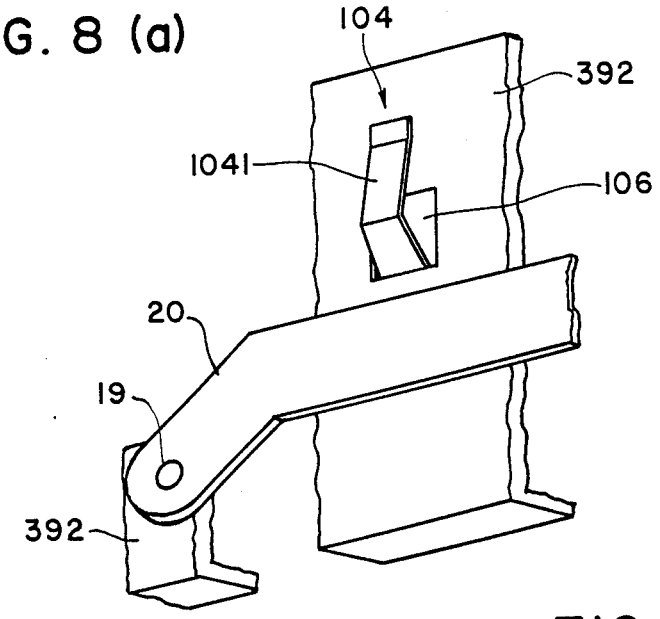
FIG. 8(*a*) is a perspective view of a holder for holding an arm attached to a sheet intruding guide provided at an entrance of the image transcription unit, according to a second embodiment of the present invention.
Figure 8:
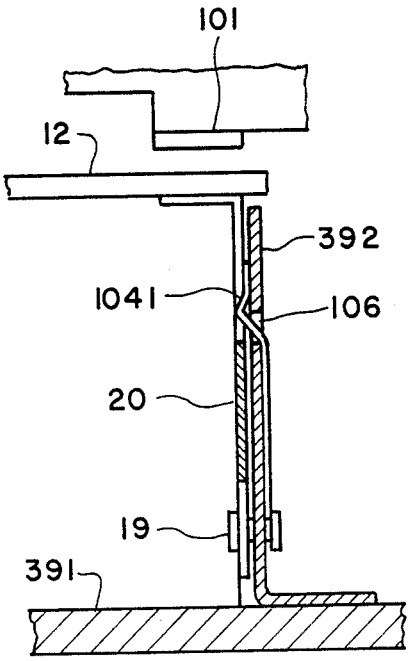
Figure 8:
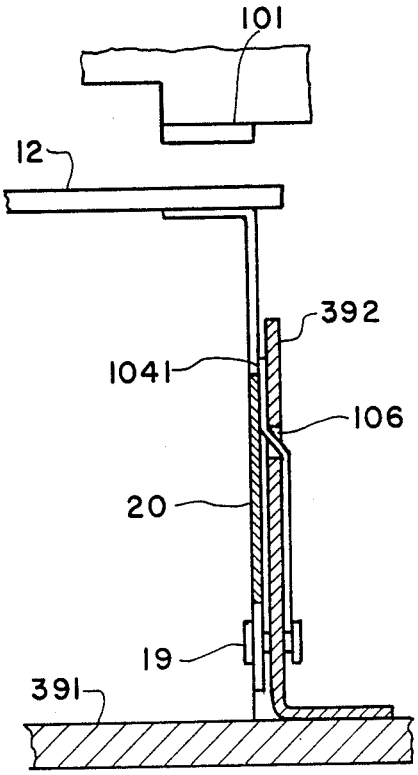

FIGS. 8(*a*), 8(*b*) and 8(*c*) illustrate the holding means of the sheet intruding guide 12. In FIGS. 8(*a*), 8(*b*) and 8(*c*), the same reference numeral as in FIG. 7(*a*) or 7(*b*) designates the same unit or part as in FIG. 7(*a*) or 7(*b*). In FIG. 8(*a*), a perspective view of the holder 104 is illustrated with the arm 20 of the sheet intruding guide 12. The arm 20 is supported by the axis 19 on a side wall 392 stood on the base frame 391 of the lower frame 39. The holder 104 is provided on the side wall 392 by using a flat spring 1041 protruded from the side wall 392 through a hole 106 and folded so as to form a roof shape.

FIG. 8(*b*) illustrates a cross-sectional view of the arm 20 released from the holder 104. In this case, the arm 20 is not reached to the protruded flat spring 1041 yet, so that the flat spring 1041 has the roof shape.

When the arm 20 is lifted up, the arm 20 reaches to the flat spring 1041 and the roof shape of the flat spring 1041 is almost flattened on the side wall 392 as shown in FIG. 8(*c*), so that the arm 20 is held by the elastic force of the flat spring 1041.

When the upper frame 41 is closed, the sheet intruding guide 12 is pushed down by the pushing member 101, releasing the arm 20 from the holder 104. Then, the flat spring is restored as shown in FIG. 8(*a*) or 8(*b*). Wherein, the pushing member 101 is used only for releasing the arm 20 from the holder 104. Therefore, when the release is over, the pushing member 101 is parted from the sheet intruding guide 12 as shown in FIG. 8(*b*). As a result, the end of the sheet intruding guide 12 is placed back to the canopy top 26 freely.

In these embodiments, the present invention is applied to the electrophotographic recording apparatus, however the present invention also can be applied to an electrostatic recording apparatus.

The concept of means disclosed in the present invention, such as the pushing mechanism of the image transcription unit to the surface of the photoconductive drum through the rollers, has been disclosed in Japanese Patent, JITSUKOSHO No. 57-3000 titled as "Charging type image transcription apparatus", by Tadayuki Kitajima and Shohji Suda in Jan. 19, 1982. However, this patent No. 57-3000 taught nothing about the sheet intruding guide and of cause the relationship between the sheet intruding guide and the image transcription unit as disclosed in the present invention. That is, as disclosed here, the sheet intruding guide, particularly the gap A between the surfaces of the sheet intruding guide and of the photoconductive drum is very important to obtained high quality of the transcribed image on the recording sheet. That is, unless keeping the gap A constant to the designated value within the predetermined tolerance, the high quality of the image is impossible to be transcribed on the recording sheet. According to the present invention, the sheet intruding guide is moved in connection with the motion of the image transcription unit for keeping the gap A to the designated value within the allowable tolerance. This is the important difference of the present invention from the patent No. 57-3000.

What is claimed is:

1. A recording apparatus for transcribing images onto recording sheets by using toner, said recording apparatus comprising:

a base frame;

a photoconductive drum for producing a toner image on a cylindrical surface thereof, rotated around a first axis fixed to said base frame;

image transcribing means for transcribing the toner image on the cylindrical surface onto the recording sheet;

first positioning means for positioning said image transcribing means to the cylindrical surface so that an image transcribing space produced between the cylindrical surface and said image transcribing means is kept to a predetermined value with a designated tolerance when said photoconductive drum is rotated, the recording sheet being contacted to the cylindrical surface and the toner image on the cylindrical surface being transcribed on the contacted recording sheet during the recording sheet is passed through the image transcribing space with the cylindrical surface rotated;

sheet intruding means for guiding the recording sheet to the image transcribing space; and second positioning means for keeping a gap between the cylindrical surface and said sheet intruding means to a predetermined value with a designated tolerance by positioning said sheet intruding means together with said image transcribing means positioned by said first positioning means.

2. A recording apparatus according to claim 1, wherein:

said image transcription means comprises pedestal means attached to said image transcription means, said pedestal means having a face;

said sheet intruding means comprises a sliding face capable of touching to the face of the pedestal means; and said second positioning means comprises second pushing means for pushing constantly the sliding face to the face of the pedestal means.

3. A recording apparatus according to claim 2, wherein:

the first axis of said photoconductive drum is set in horizontal;

said first positioning means positions said image transcription means in accordance with the rotating cylindrical surface, by pushing said image transcription means vertically along a vertically directed radius of said photoconductive drum, using first pushing means pushing said image transcription unit from said base frame; and the face of the pedestal means is positioned horizontally.

4. A recording apparatus according to claim 3, wherein, the first pushing means comprises springs stood vertically on said base frame so as to be placed between said image transcription means and said base frame, and the second pushing means of said second positioning means comprises an arm sustained by a second axis, fixed to said base frame, so that the arm is freely rotatable in a vertical plane, said sheet intruding means being provided at the end of the arm so that the sliding face is pushed to the face of the pedestal means, using the weight produced by said sheet intruding means and the arm sustained by the second axis.

5. A recording apparatus according to claim 4 further comprising:

a lower frame for installing at least said base frame and means comprising said image transcription means, said first positioning means, said sheet intruding means and said second positioning means; and an upper frame for installing at least said photoconductive drum, said upper frame being capable of being opened, leaving said lower frame in horizontal.

6. A recording apparatus according to claim 5, wherein:

said lower frame comprises holding means attached to said base frame for holding the arm so that said sheet intruding means is kept to a situation being lifted up, the arm being held by the holding means after said upper frame is opened; and said upper frame comprises third pushing means for pushing said sheet intruding means for setting the sliding face of said sheet intruding means back to the face of the pedestal means, releasing the arm from said holding means, when said upper frame is closed to said lower frame.

* * * * *

UNITED STATES PATENT AND TRADEMARK OFFICE

CERTIFICATE OF CORRECTION

PATENT NO. : 4,896,191

DATED : January 23, 1990

INVENTOR(S) : Keiji Ohyabu et al.

It is certified that error appears in the above-identified patent and that said Letters Patent is hereby corrected as shown below:

Front Page, [30] line 1, "Sep. 10, 1987" should be --Sep. 19, 1987--;
line 2, "Mar. 19, 1988" should be --Mar. 10, 1988--.

Col. 2, line 64, "D" should be --$D_2$--.

Col. 8, line 37, "unit, 11" should be --unit 11--.

Signed and Sealed this

Ninth Day of July, 1991

*Attest:*

HARRY F. MANBECK, JR.

*Attesting Officer*

*Commissioner of Patents and Trademarks*